US009808694B2

(12) United States Patent
Stevens

(10) Patent No.: US 9,808,694 B2
(45) Date of Patent: Nov. 7, 2017

(54) MARTIAL ARTS TRAINING DEVICE

(71) Applicant: Michael Wayne Stevens, Conway, SC (US)

(72) Inventor: Michael Wayne Stevens, Conway, SC (US)

( * ) Notice: Subject to any disclaimer, the term of this patent is extended or adjusted under 35 U.S.C. 154(b) by 0 days.

(21) Appl. No.: 14/944,421

(22) Filed: Nov. 18, 2015

(65) Prior Publication Data

US 2017/0136330 A1 May 18, 2017

(51) Int. Cl.
*A63B 69/20* (2006.01)
*A63B 69/00* (2006.01)

(52) U.S. Cl.
CPC ..... *A63B 69/004* (2013.01)

(58) Field of Classification Search
USPC ..... 482/1–148
See application file for complete search history.

(56) References Cited

U.S. PATENT DOCUMENTS 5,389,057 A * 2/1995 Zagata, Jr. ..... A63B 69/20 482/83
5,509,629 A * 4/1996 Sassmannshausen . F16M 11/16 248/169
5,876,011 A * 3/1999 Blasing ..... F16M 11/28 248/170
5,899,835 A * 5/1999 Puranda ..... A63B 69/34 482/83
6,390,958 B1 * 5/2002 Chu ..... A63B 69/20 482/83
6,978,974 B1 * 12/2005 Marasco ..... A63H 17/12 248/124.1
7,981,009 B2 * 7/2011 Brenner ..... A63B 69/34 482/83
7,998,035 B2 * 8/2011 Chen ..... A63B 69/208 482/83
8,617,034 B2 * 12/2013 Eem ..... A63B 69/203 482/83
8,641,583 B2 * 2/2014 Chen ..... A63B 69/20 482/83
8,690,739 B2 * 4/2014 Fazio ..... A63B 69/34 482/86
8,814,759 B2 * 8/2014 Goldy ..... A63B 69/24 482/83
9,316,016 B2 * 4/2016 Brooks ..... E04H 12/2223
2007/0167297 A1 * 7/2007 Stevenson ..... A63B 69/004 482/83
2007/0197348 A1 * 8/2007 Ku ..... A63B 69/24 482/83

(Continued)

*Primary Examiner* — Stephen R Crow

(57) ABSTRACT

A martial arts training device is provided. The device includes a stand. The base slides over the stand and is fillable to support the stand in an upright position when in use and resting on a surface. A main frame portion is secured to a top end of the stand, rotatable horizontally. At least one bar is secured to the main frame portion, rotatable vertically. The bar includes a foam padding about its second end. At least one counterweight is secured to the axle portion of the main frame portion and rotatable about the horizontal axis. The counterweight protrudes from a second side of the axle portion of the main frame portion opposite from the first side. A piston return portion can be optionally installed over the bar portion of the axle bar receiver. A "C" spring secures to the main frame portion directly below the bar.

7 Claims, 6 Drawing Sheets

(56) References Cited

U.S. PATENT DOCUMENTS

| | | | | |
|---|---|---|---|---|
| 2011/0251024 | A1* | 10/2011 | Hu | A63B 69/20 482/90 |
| 2013/0109541 | A1* | 5/2013 | Fu | A63B 69/208 482/90 |
| 2013/0324372 | A1* | 12/2013 | Cuadrado | A63B 69/20 482/90 |
| 2014/0302969 | A1* | 10/2014 | Chen | A63B 69/203 482/90 |
| 2016/0023078 | A1* | 1/2016 | Haselrig | A63B 69/004 482/87 |

* cited by examiner

FIG.11
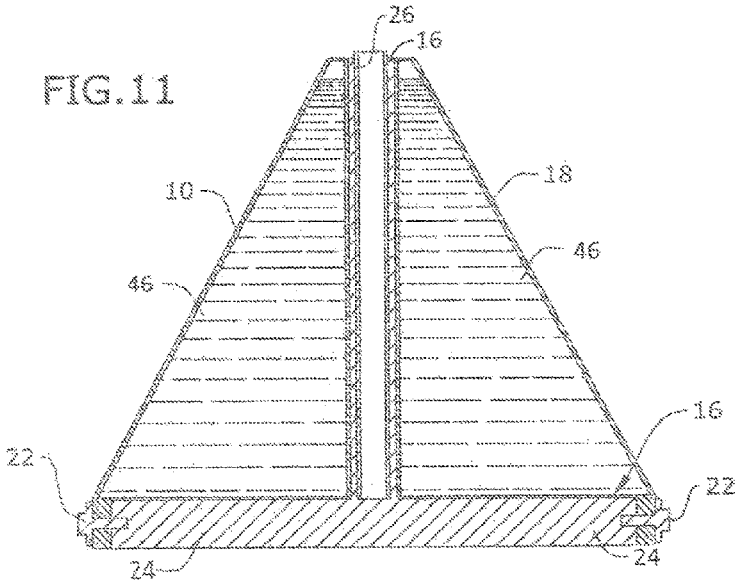
FIG.12
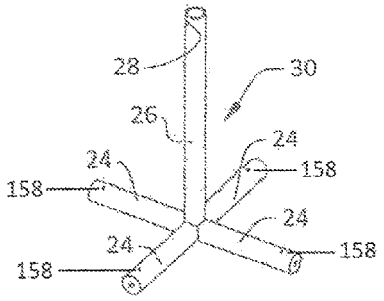
FIG.14
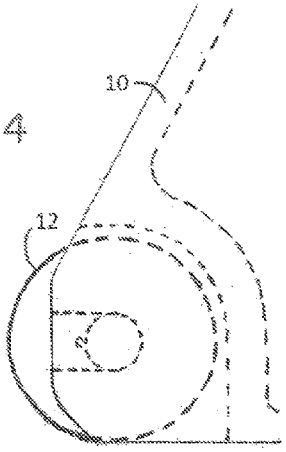
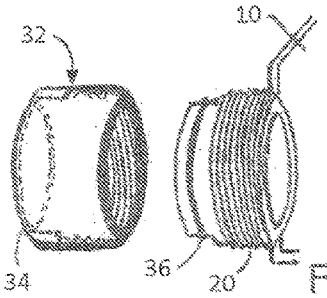
FIG.13
FIG.14a
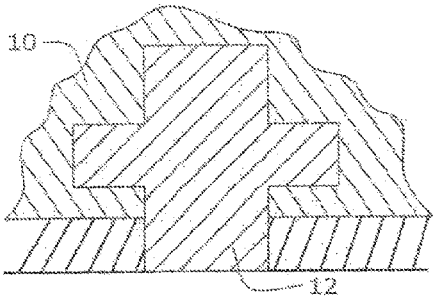
FIG.15
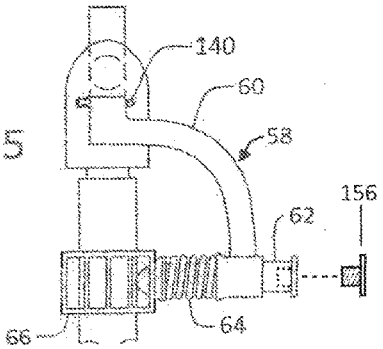

MARTIAL ARTS TRAINING DEVICE

BACKGROUND OF THE INVENTION

The present invention relates to martial arts training and, more particularly, to a martial arts training device with lifelike movements.

There are different types of martial arts training devices. Punching bags are the most popular. Speed bags are small, air-filled bags anchored at the top to a rebound platform parallel to the ground. A heavy bag is a larger, cylindrical bag, usually suspended by chains or ropes and used for practicing powerful body punches, and can be used to toughen hands or any other limb used to hit the bag. Body-shaped training aids such as the modern "body opponent bag" are made primarily of synthetic materials, and punching bags are sometimes mounted on a weighted pedestal rather than hanging from above.

The above-mentioned martial arts training devices are stationary, must be held by a second user, or have a very limited range of motion. The constraints of other martial arts training devices do not allow for a lifelike variety of possible movements, strikes, and exercises.

As can be seen, there is a need for an improved strike training device that mimics lifelike movements.

SUMMARY OF THE INVENTION

In one aspect of the present invention, a martial arts training device comprises: a stand, having legs, configured to support the martial arts training device in an upright position when resting on a surface; a hollow base, fillable to stabilize the stand, having a shaft and channels that permit the base to slide over the stand; a main frame secured atop the vertical end of the stand, rotatable horizontally; an axle securing an axle-bar receiver inside the vertical portions of the main frame, rotatable vertically; at least one bar secured to and protruding from the bar receiver portion of the axle-bar receiver; a pad secured over the second end of the bar; at least one threaded rod secured to a side end of the axle, protruding to the outside of the main frame vertical portion; and at least one weight secured to the threaded rod.

These and other features, aspects, and advantages of the present invention will become better understood with reference to the following drawings, description, and claims.

BRIEF DESCRIPTION OF THE DRAWINGS

FIG. 11 is a section detail view of the present invention along line 11-11 in FIG. 1;

FIG. 12 is a perspective detail view of an embodiment of the present invention;

FIG. 13 is a perspective detail view of the present invention along line 13-13 in FIG. 1;

FIG. 14 is a section detail view of the present invention.

Figure 1:
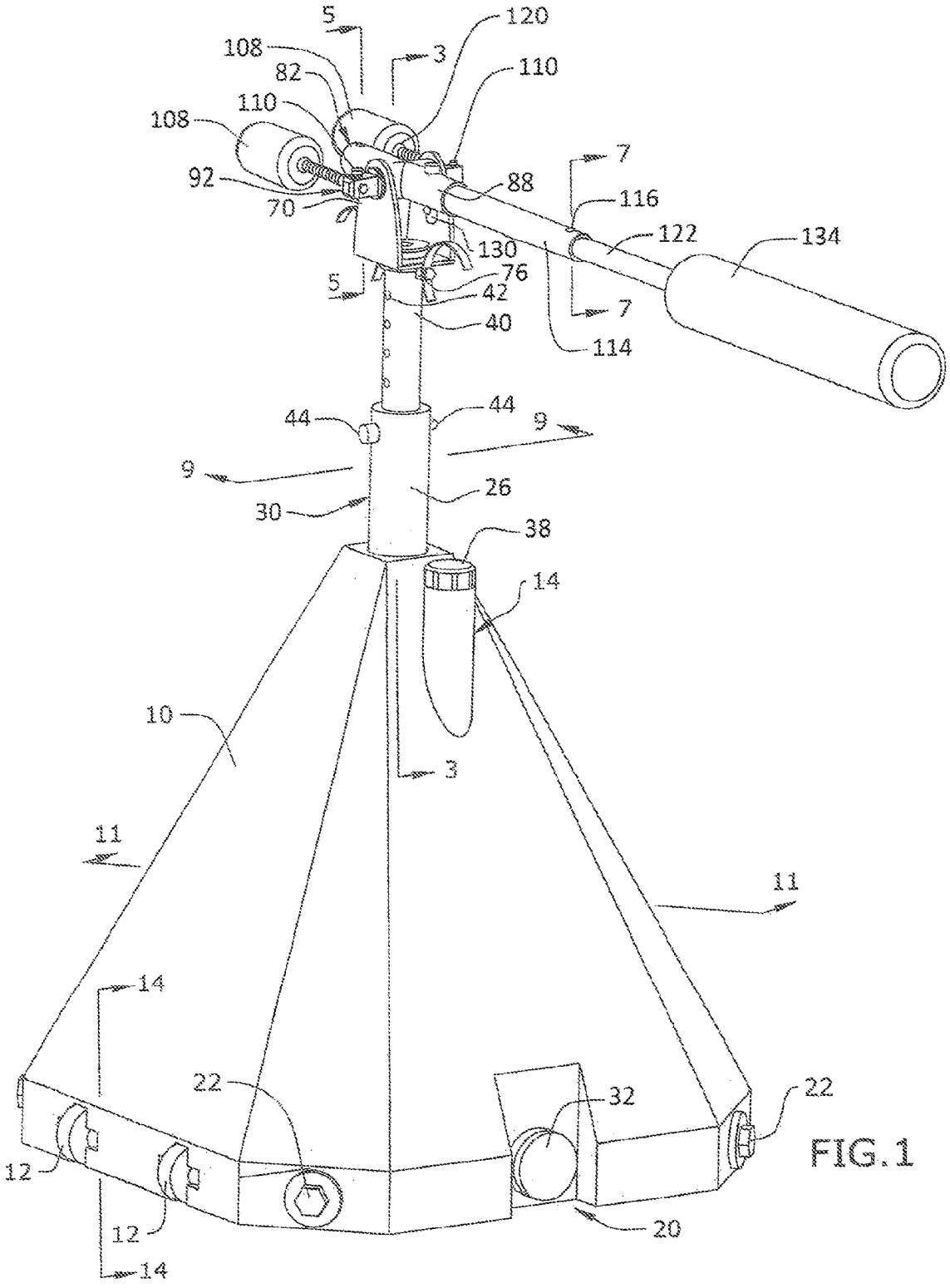
FIG. 1 is a perspective view of an embodiment of the present invention.
Figure 3:
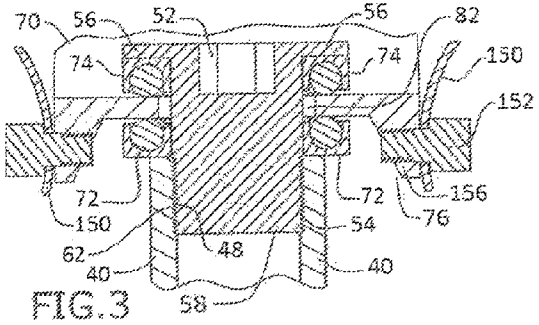
FIG. 3 is a section detail view of the present invention along line 3-3 in FIG. 1.
Figure 4:
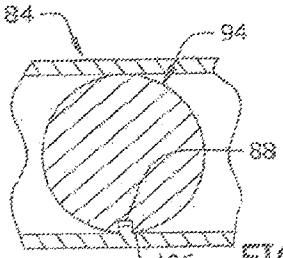
FIG. 4 is a section detail view of an embodiment of the present invention.
Figure 2:
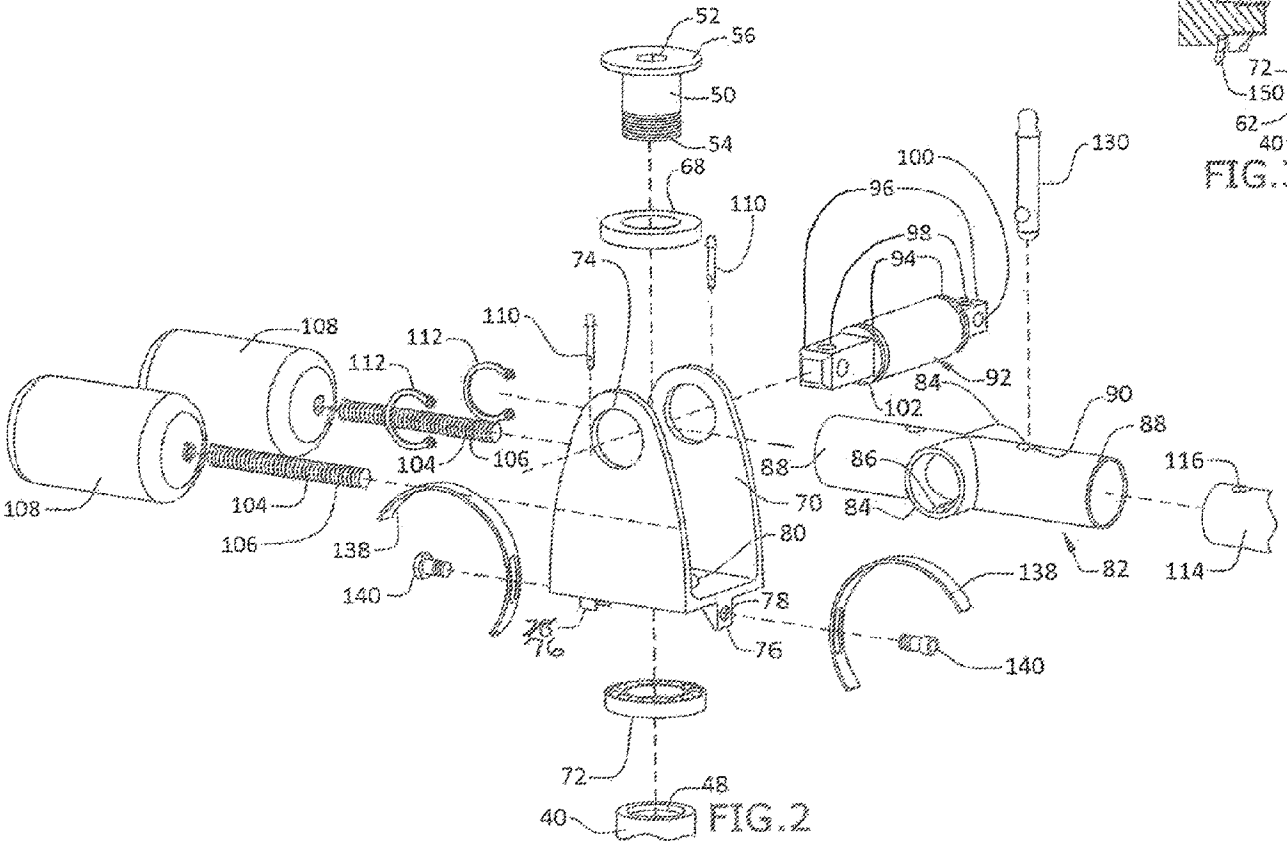
FIG. 2 is a detail exploded view of an embodiment of the present invention.
Figure 5:
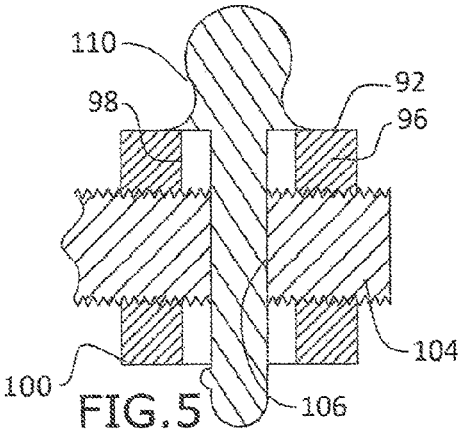
FIG. 5 is a section detail view of the present invention along line 5-5 in FIG. 1.
Figure 6:
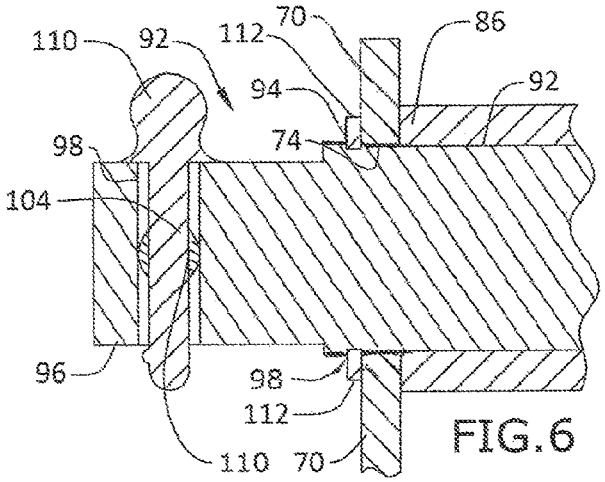
FIG. 6 is a section detail view of an embodiment of the present invention.
Figure 7:
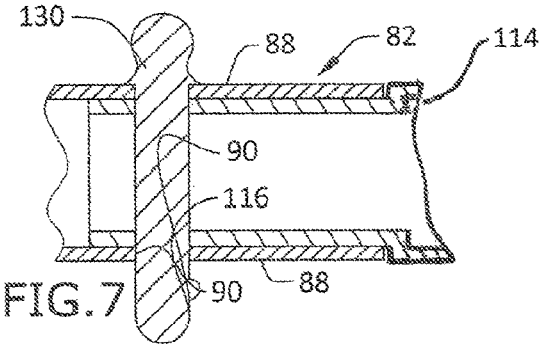
FIG. 7 is a section detail view of the present invention along line 7-7 in FIG. 1.
Figure 8:
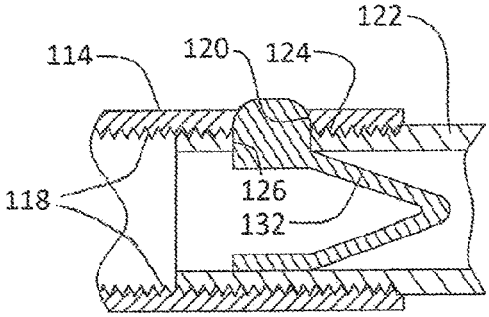
FIG. 8 is a section detail view of an embodiment of the present invention.
Figure 9:
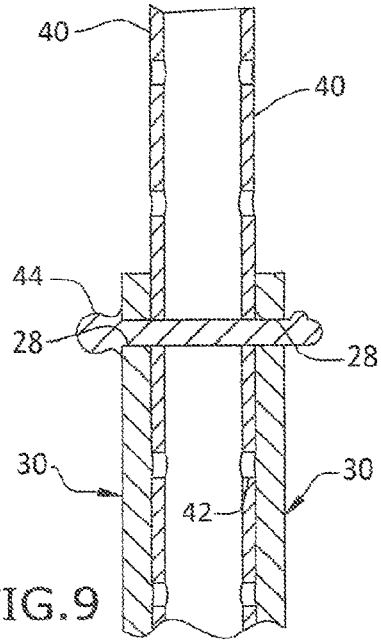
FIG. 9 is a section detail view of the present invention along line 9-9 in FIG. 1.
Figure 10:
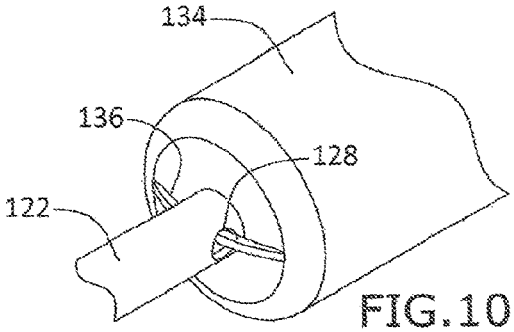
FIG. 10 is a perspective detail view of an embodiment of the present invention.
Figure 16:
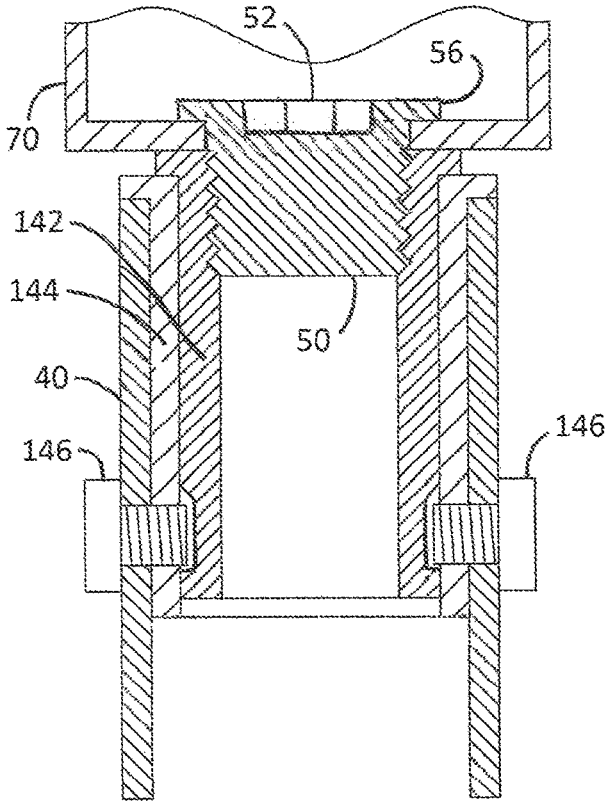
Figure 17:
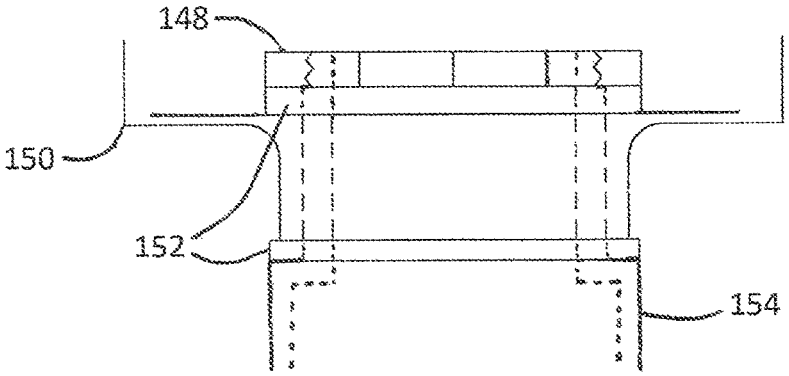
Figure 18:
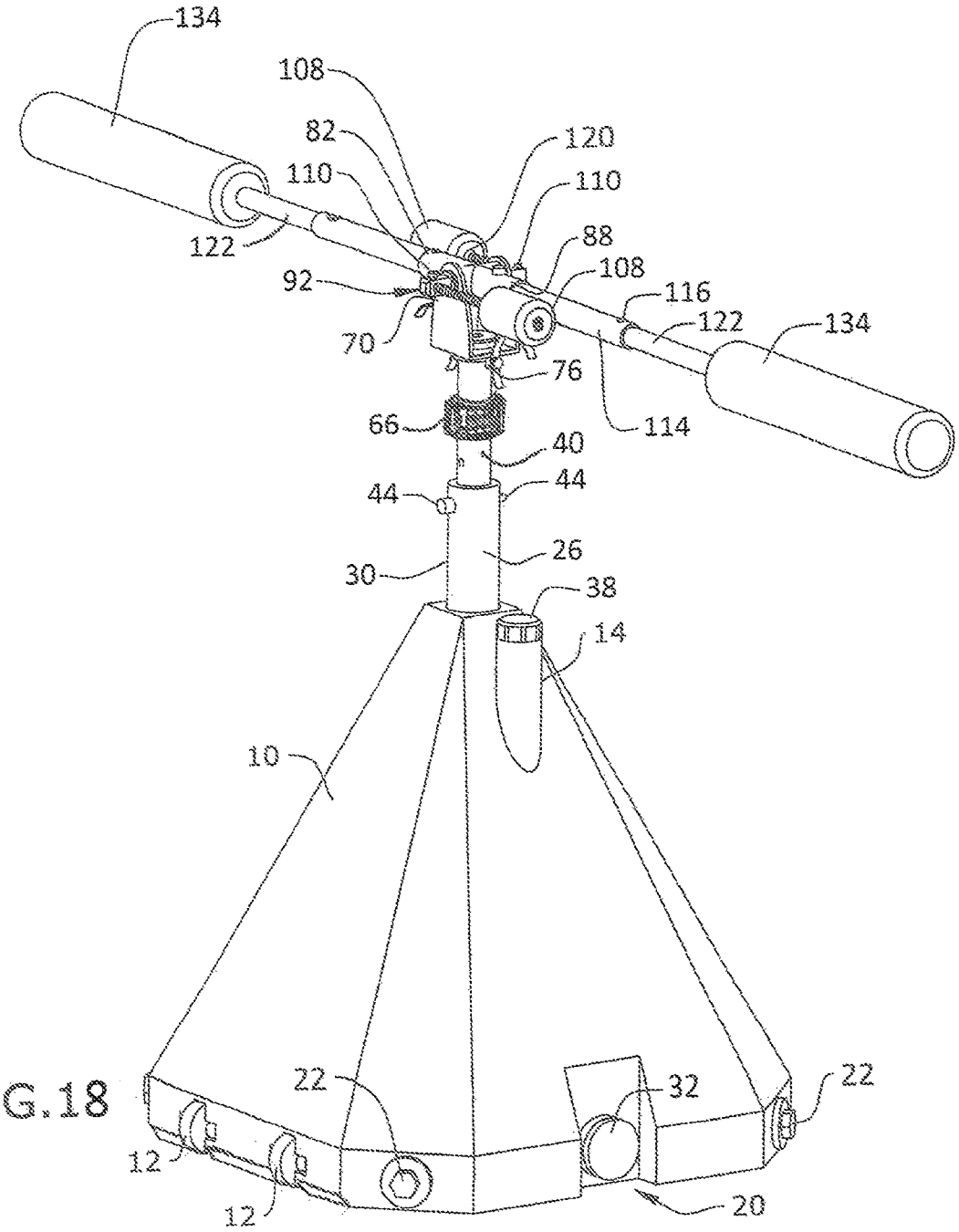

FIG. **14*a* is a section detail view of the present invention along line 14-14 in FIG. 1**;

FIG. 15 is a perspective detail view of the an alternate embodiment of the present invention;

FIG. 16 is a section detail view of the present invention along line 3-3 in FIG. 1 replacing the bearing with polymer or non-friction type rings;

FIG. 17 is a section detail view of the present invention along line 3-3 in FIG. 1 replacing the bearing with polymer or non-friction type rings; and FIG. 18 is a perspective view of an embodiment of the present invention with a second extension bar, bar, pad, and an alternate configuration.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a device used for martial arts training and/or exercise. The present invention enables the user to increase strength, speed, and hand-eye coordination, without requiring electrical power. The present invention includes a bar or bars with an attached pad or pads that can rotate atop a stand. When struck, the bar and pad rotate around the stand and are capable of moving up, down, or remaining at the same height while in motion, returning to the user and allowing the user to strike the pad or pads again. The level of the pad's return can vary from near the ground to over six feet high. The speed of the bar and pad's rotation or vertical motion depends on the force and direction of the user's strike, allowing for different levels of intensity and difficulty. The action of rapidly striking the moving pad or pads enables users to increase strength, speed, and hand-eye coordination. The present invention is improved as compared to prior art devices by allowing users to train alone or with a second user, train at low, intermediate, or high speeds, and use a wider range of movements, strikes, and exercises when reacting to the approach of the pad or pads.

Referring to FIGS. 1 through 18, the present invention includes a martial arts training device. The martial arts training device includes a stand 30. The stand 30, having legs 24, configured to place the martial arts training device in an upright position when resting on a surface. A main frame 70 is secured to a top end of the inner vertical tube 40 of the stand 30, rotatable horizontally. An axle 92 securing an axle bar receiver 82 to the vertical portion of the main frame 70, the axle 92 enabling the axle bar receiver to rotate vertically. A bar 122 is secured to the bar receiver portion 88 of the axle-bar receiver 82. The bar 122 includes a foam pad 134 mounted over its second end. At least one weight 108 is secured by a threaded rod 106 to a side end 100 of the axle 92.

The base 10 of the present invention may include a wheel or wheels 12 located near a bottom to facilitate the easy transportation of the martial arts training device. Further, the base 10 of the present invention may include a housing forming an inner cavity 18. Fluids, sand, or like substances 46 may fill the inner cavity 18 to provide weight and add stability to the stand 30. A fill port 14 to the inner cavity 18 may be located near a top end of the base 10 and a drain port 20 from the inner cavity 18 may be located at a bottom side of the base 10. The fill port 14 may be covered by a fill port cap 38 and the drain port 20 may be covered by a drain port cap 32. The drain port cap 32 may be sealed to the drain port 20 with an inner gasket 34 in the drain port cap 32 and an O-ring 36 on the drain port 20 to prevent leaking.

The base 10 may further include vertical and horizontal cavities 16. The stand's horizontal legs 24 may be secured within the horizontal portions of the cavities 16, formed in the bottom of the base 10, by fasteners 22 extending through the bottom sides of the base 10. In certain embodiments, the stand may include an inner vertical tube 40 disposed within the outer vertical tube 26, forming a telescopic vertical member. The inner tube 40 may include a plurality of horizontally disposed holes 42. Each of the horizontally disposed holes 42 may align with a pin hole 28 formed horizontally through the vertical tubing 26, 40. A lock pin 44 may fit within the aligned holes 28, 42 to secure the stand's inner vertical tube 40 at a specified height. The telescopic adjustable inner vertical tube allows users to adjust the martial arts training device to different heights. The stand's horizontal legs 24 comprising a hole 158 through their second sides to optionally secure the stand 30 to a surface, thereby removing the necessity of installing the base.

The main frame 70 includes a bottom and a pair of sides extending vertically from either side of the bottom. The bottom may include an opening 80 and the sides may each include axle openings 74. The present invention may further include a bolt 50. The bolt 50 may include a threaded end 54 and an upper flange 56 with a tool slot 52 for tightening and loosening the bolt 50. The bolt 50 may run through the bottom opening 80 of the main frame 70 and into an upper female threading 48 formed atop the vertical portion of the stand's inner tube 40, securing the main frame portion 70 of the invention atop the stand's inner vertical tube 40.

The main frame 70 may rotate horizontally about the bolt 50. In certain embodiments, the present invention may include elements that aid the main frame 70 in rotation. For example, the present invention may include an upper bearing 68 and a lower bearing 72 disposed about the bolt 50 and sandwiching the bottom of the main frame 70 atop the inner vertical tube 40 of the stand 30. The main frame 70 may thereby rotate horizontally between the bearings 68, 72. In certain embodiments, the bearings can be replaced by washers 152 or a sleeve 144 made of polymer or any non-friction material permitting easy rotation of the main frame 70.

The axle receiver portion 84 of the axle bar receiver 82 may include an internal rail 86. The axle 92 having a receiver rail 102. The axle 92 fits within the axle receiver portion 84 of the axle bar receiver 82 such that the receiver rail 102 on the axle 92 mates with the internal rail 86 in the axle receiver 84. The axle 92 fits through the axle holes 74 in the vertical portions of the main frame 70, thereby attaching the axle 92 and axle receiver 84 to the main frame 70. Lock rings 112 may fit within the ring slot 94 formed on either side of the axle 92 thereby preventing the axle 92 from sliding out of the axle holes 74 of the main frame 70.

As mentioned above, the present invention includes a bar 122 having a foam pad 134 secured over its second end. The bar 122 may include an extension bar 114. The extension bar 114 includes a first end that fits within a first side of the bar receiver portion 88 of the axle bar receiver 82. A pin hole 116 formed through the extension bar 114 may align with a hole 90 formed through the axle bar receiver 82. A lock pin 130 fits within the aligned hole 90 and hole 116, thereby forming a releasable attachment between the extension bar 114 and the bar 122 and the bar receiver 82. A second end of the extension bar 114 may include a threaded receiver 118 with a spring button hole 120. The bar 122 may include a first end having a male threaded portion 124. The male threaded portion 124 mates with the threaded receiver 118 of the extension bar 114. A spring button clip 132 may be disposed within the bar 122. A spring button of the spring button clip 132 runs through a button hole 126 of the bar 122 and into the button hole 120 of the extension bar 114, thereby securing the bar 122 to the extension bar 114. The bar 122 may further include a foam pad 134. The foam pad 134 may include a tie string, wire, or cord 136. The tie 136 secures within a bar hole 138 formed near the middle of the bar 122, thereby connecting the foam pad 134 to the bar 122.

As mentioned above, the present invention further includes at least one weight 108, such as two weights 108. The weights 108 may include a threaded shaft through the center of their lengths, a male threaded rod 104 that may include a lock pin hole 106. The threaded rod 104 may mate with a weight 108 and a threaded slot 100 on the first end of the axle 92. The lock pin hole 106 aligns with a pin slot 98 of the first end of the axle 92. A lock pin 110 may run through the aligned lock pin hole 10 and pin slot 98, further securing the threaded rod 104.

In certain embodiments, the present invention may include springs 138. The springs 138 may be secured to the main frame 70 below the bar receiver portions 88 of the axle bar receiver 82. The springs 138 may be C-shaped. In certain embodiments, the main frame 70 may include lower protrusions 76 extending downward from opposite sides of the bottom of the main frame 70. Threaded holes 78 may be formed through each lower protrusion 76. The springs 138 may be secured to the main frame 70 by running threaded bolts 140 through holes formed in the springs 138 and into the threaded holes 78 of the lower protrusions 76. The springs 138 are located within the same vertical rotational path as the bar 122, preventing the bar 122 from hitting the ground.

A method of using the present invention may include the following. A user may attach a bar 122 to either or both sides of the bar portion 88 of the axle bar receiver 82. The user may attach the weights 108 by way of the threaded rod 104 to either or both sides of the first end and the second end of the axle 92, as illustrated in FIG. 1. As illustrated in FIG. 19, weights 108 and a bar 122 with a pad 134 secured over its second end are secured within the bar receiver portion 88 of the axle bar receiver 82 on a first side, and a second bar 122 with pad 134 is secured in like manner within the bar receiver 88 of the axle bar receiver 82 on a second side opposite the first side. A first weight 108 may be secured to a threaded rod 104 and a threaded rod 104 secured to the first end of the axle 92 on the same side as the first bar 122 and a second weight 108 may be secured to a second threaded rod 104 and then secured to the second end of the axle 92 on the same side as the second bar 122. However, the present invention is not limited to the above mentioned configurations. Once the bar 122, threaded rod 104, and weights 108 are attached to the axle 92 and axle bar receiver 82, the height of the stand may be adjusted by raising or lowering the inner vertical tube 40, or by adjusting the height of the pad or pads 134 by adjusting the weight or weights 108. The user may then strike the pad 134, and the bar 122 may rotate up, down, and/or around. There is no limit to possible direction. The speed of the rotations is dependent on how much force is applied to the pad 134. The bar or bars 122 may continue to rotate, and the user may continue to hit or block the pad or pads 134, thereby performing diverse martial arts training.

As illustrated in FIG. 15, the present invention may include a piston return 58. The piston return 58 may include a first end and a second end. The first end may be secured by a pin 140 over the bar receiver portion 88 of the axle bar receiver 82 on a side opposite a bar 122. The piston return 58 may curve from the first end to the second end 60. The second end may include a piston 62, having its spring 64 secured to its shaft and itself secured to the second end of the piston return arm 60 by the piston end threaded stop 156. The piston may be slidably engaged within the inner vertical tube cage 66, and a spring 64 may be disposed in between the second end of the piston return 60 and a piston head 62. The stand's inner vertical tube 40 may include a cage 66 sized to receive a piston head 62. In such embodiments, the user may strike the foam pad 134 vertically upward, the piston return 58 may rotate vertically downward, and the piston head 62 may partially enter the cage 66, thereby preventing any horizontal movement, and adding tension to the spring 64. The tension from the spring 64 may launch the pad 134 back in the direction of the user, allowing another strike.

It should be understood, of course, that the foregoing relates to exemplary embodiments of the invention and that modifications may be made without departing from the spirit and scope of the invention as set forth in the following claims.

What is claimed is:

1. A martial arts training device comprising: a stand configured with horizontal legs connected at their first ends and a vertical leg connected to the top sides at the first ends of the horizontal legs, a base configured for containment to removably mate with and stabilize the stand while the martial arts training device is in use, an inner vertical leg adjustably nested inside the vertical leg, a main frame portion secured atop the inner vertical leg rotatable about a vertical axis; wherein the main frame portion comprises:

(a) a bottom and a pair of sides, wherein the bottom and each of the sides comprise an opening;

(b) a bolt, screw, or pin installed through the bottom opening to releasably secures the main frame to the top of the inner vertical leg, (c) a top and bottom bearing, washer, or sleeve disposed about the bottom bolt, screw, or pin for securing the main frame such that the bottom of the main frame is disposed therebetween, thereby permitting horizontal movement about the bolt, screw, or pin, (d) an axle inserted through an axle bar receiver, the axle having a first and second end rotatably secured through the openings in the side portions of the main frame portion, which also releasably secures the axle bar receiver between the side wall portions of the main frame portion, thereby permitting vertically rotation of the axle and axle bar receiver, (e) a rod or rods being releasably and adjustably connected to either or both side ends of the axle, a weight releasably and adjustably connected to a rod or rods thereby permitting vertical rotation of the weight and rod about the axle, (f) a bar or bars having a hole near the middle and hole near the first and second ends that when aligned with another bar or the axle bar receiver a pin inserted through the holes near the ends, releasably secures the bar or bars to another bar or the axle bar receiver, (g) a pad or pads comprising a soft replaceable interior material and a cover made of impact resistant material configured to be secured over the soft interior material comprising a draw string, rope, or wire about its first end, wherein, the pads soft replaceable interior material is configured to slide over the second end of the bar being releasably secured by inserting the string, rope, or wire through the hole near the middle of the bar, resulting in a fluid circular motion of a pad in any direction between completely horizontal and completely vertical when the bar and pad are connected to the axle bar receiver and the martial arts training device is in use, (h) at least one c-shaped spring adjustably secured to the main frame portion directly below the bar to stop the downward motion of the bar, (i) an optionally installed return configured to be releasably secured to either bar side of the axle bar receiver portion of the main frame by a bolt, screw or pin and having a piston portion of the return configured to be captured by the cage about the inner vertical leg, such that when the pad is moving in an upward direction and is near vertical, the spring portion about the middle of the piston portion returns the pad downward to the same place about the horizontal circumference where the pad began its upward motion.

2. The martial arts training device of claim 1 wherein the horizontal legs each include a vertical hole through the top and bottom near the second end of the legs to optionally secure the stand to a floor or the ground by use of stakes, screws, or nails and a hole in the second ends to optionally secure the base.

3. The martial arts training device of claim 1 wherein the stand's vertical leg comprises a hole extending through its sides horizontally just below its top end.

4. The martial art training device of claim 1, wherein the base comprises a chamber having a fill port and a drain port, wherein the chamber is configured to contain at least sand or water, with holes in the bottom sides of the base to align with the holes in the second end of the stand's horizontal legs to optionally secure the base to the stand with either screws, bolts, or pins.

5. The martial arts training device of claim 1, wherein the inner vertical leg comprises a cage affixed about its sides near the top end, and holes extending horizontally through the side of the inner leg beginning just below the cage and continuing downward to near its bottom end, which when aligned with the hole in the vertical leg can be releasably secured by a pin, bolt or screw.

6. The martial arts training device of claim 1, wherein the base comprises at least one wheel for transport.

7. A martial arts training device comprising: a stand configured with horizontal legs connected at their first ends and a vertical leg connected to the top sides at the first ends of the horizontal legs, a base configured for containment to optionally removably mate with and stabilize the stand while the martial arts training device is in use, an inner vertical leg adjustably nested inside the vertical leg, a main frame portion secured atop the inner vertical leg rotatable about a vertical axis; wherein the base comprises a chamber having a fill port and a drain port, wherein the chamber is configured to contain at least one of sand and or water, with holes in the bottom sides of the base to align with the holes in the second end of the stand's horizontal legs to optionally secure the base to the stand with either screws, bolts, or pins.

* * * * *